United States Patent [19]

Sakai et al.

[11] Patent Number: 4,922,705

[45] Date of Patent: May 8, 1990

[54] CLEANING DEVICE FOR A DRAFTING DEVICE IN A SPINNING MACHINE

[75] Inventors: Shoji Sakai, Nagaokakyo; Yukio Iwai, Ohtsu, both of Japan

[73] Assignee: Murata Kikai Kabushiki Kaisha, Kyoto, Japan

[21] Appl. No.: 221,737

[22] Filed: Jul. 20, 1988

[30] Foreign Application Priority Data

| | | | |
|---|---|---|---|
| Jul. 22, 1987 | [JP] | Japan | 62-182605 |
| Sep. 24, 1987 | [JP] | Japan | 62-145712 |
| Nov. 6, 1987 | [JP] | Japan | 62-280569 |

[51] Int. Cl.[5] ..... D01H 5/64; D01H 5/60

[52] U.S. Cl. ..... 57/306; 57/300; 19/245; 19/262

[58] Field of Search ..... 57/300, 306, 315; 19/200, 202, 203, 108, 110, 111, 113, 126, 128, 245, 262, 264

[56] References Cited

U.S. PATENT DOCUMENTS

| | | | |
|---|---|---|---|
| 2,051,793 | 8/1936 | Casablancas | 19/245 |
| 2,362,782 | 11/1944 | Truslow et al. | 19/245 |
| 4,590,646 | 5/1986 | Gasser | 19/262 |

FOREIGN PATENT DOCUMENTS

| | | | |
|---|---|---|---|
| 665447 | 6/1963 | Canada | 19/245 |
| 29279 | 4/1884 | Fed. Rep. of Germany | 19/262 |
| 2800578 | 7/1979 | Fed. Rep. of Germany | 57/306 |
| 328128 | 7/1935 | Italy | 19/245 |

*Primary Examiner*—Donald Watkins

*Attorney, Agent, or Firm*—Spensley Horn Jubas & Lubitz

[57] ABSTRACT

A cleaning device for a drafting device in a spinning machine comprises a clearer device provided at a drafting device of each of a large number of spindles provided in a row in the spinning machine, and a collecting device for fiber waste which reciprocally moves along the large number of spindles provided in a row above the clearer devices while contacting with the clearer devices and exfoliates and removes fiber waste from the clearer devices for the individual spindles.

25 Claims, 4 Drawing Sheets

CLEANING DEVICE FOR A DRAFTING DEVICE IN A SPINNING MACHINE

FIELD OF THE INVENTION AND RELATED ART STATEMENT

This invention relates to a cleaning device for a drafting device in a spinning machine.

In a drafting device in a spinning machine, a clearer device is provided for removing fiber waste such as staple or dust sticking to rollers which constitute the drafting device.

Various types of clearer devices have been developed including a roller type and an endless belt type. In most cases, however, a roller or a belt having a large amount of nap or fluff on a surface thereof is moved in contact with a draft roller or an apron belt to scrape off fiber waste sticking to the surface of the roller or the belt.

Accordingly, fiber waste exfoliated and removed from the drafting device is accumulated in the clearer device as time passes, and if such fiber waste is accumulated to a large amount, such a trouble may appear that fiber waste sticks to the drafting device reversely from the clearer device. Accordingly, fiber waste accumulated in the clearer device must be removed after each lapse of a fixed interval of time. However, since the fact that a force required for the clearer device to remove fiber waste from the drafting device is high signifies that the force of the clearer device to hold fiber waste thereon is correspondingly high, if the force of the clearer device is high, reversely it becomes difficult to collect fiber waste from the clearer device. Due to such circumstances as described just above, conventionally either an operator removes fiber waste accumulated in the clearer device directly with his hand or a special collecting device such as a sucking device is employed. However, except by manual operation, sufficient collection of fiber waste from the clearer device cannot be anticipated.

OBJECT AND SUMMARY OF THE INVENTION

It is an object of the present invention to provide a cleaning device for a drafting device in a spinning machine wherein the efficiency in collection of fiber waste from a clearer device is high and collection of fiber waste can be effected automatically for a large number of spindles.

A cleaning device for a drafting device in a spinning machine according to the present invention comprises a clearer device provided at a drafting device of each of a large number of spindles provided in a row in the spinning machine, and a collecting device for fiber waste which reciprocally moves along the large number of spindles provided in a row above the clearer devices while contacting with the clearer devices and exfoliates and removes fiber waste from the clearer devices for the individual spindles, and fiber waste is scraped off directly from the clearer devices by the collecting device.

DETAILED DESCRIPTION OF THE PREFERRED EMBODIMENTS

Figure 1:
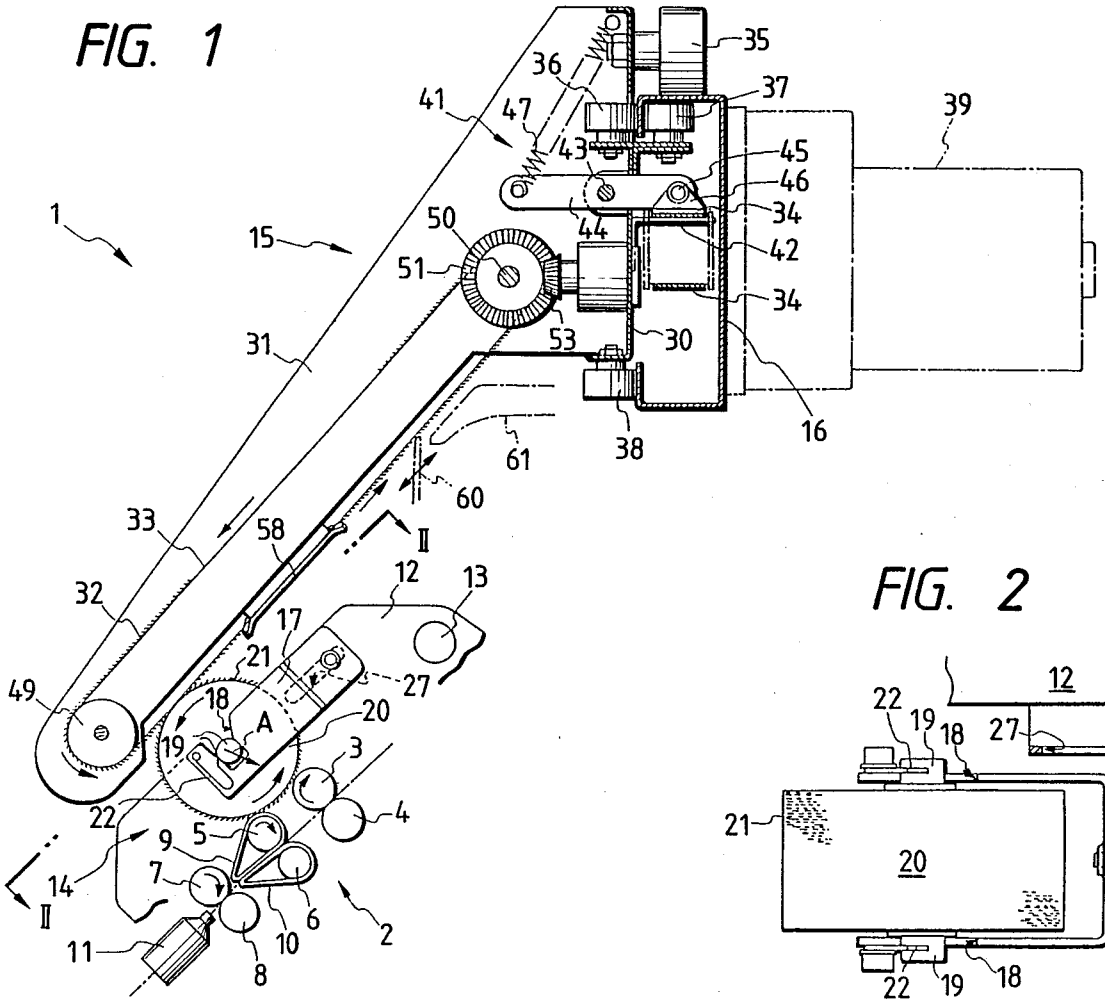
FIG. 1 is a side elevational sectional view of a drafting device of a spinning machine which is provided with a cleaning device according to the present invention, FIG. 2 a plan view of a clearer device (a sectional view taken along line II—II of FIG. 1), FIG. 3 a front elevational view of a collecting device, FIG. 4 a sectional view taken along line IV—IV of FIG. 3, FIG. 5 a front elevational view of a guide member.

FIG. 1 is a side elevational view of a drafting device 2 of a spinning machine which is provided with a cleaning device 1 according to the present invention, and the spinning machine of the present embodiment is a pneumatic spinning machine which includes a so-called three-line drafting device 2 composed of a pair of back rollers 3 and 4, a pair of middle rollers 5 and 6, a pair of front rollers 7 and 8 and a pair of apron belts 9 and 10 extending around the middle rollers 5 and 6, respectively, an air jetting nozzle 11 provided at a next stage to the drafting device 2, and a winding device not shown at a further next stage. A large number of such spinning units composed of the individual listed components are provided in a row in a direction perpendicular to the plane of FIG. 1.

Reference numeral 12 denotes a cradle supported for pivotal motion at 13 on a frame not shown, and upper side ones 3, 5 and 7 of the draft rollers 3, 4, 5, 6, 7 and 8 are supported on the cradle 12.

And, in the present embodiment, a clearer device 14 for the drafting device 2 is provided and supported on the cradle 12, and a fiber waste collecting device 15 for exfoliating and collecting fiber waste sticking to the clearer device 14 is provided and supported for movement on a channel member 16 which extends along the direction of the row of the large number of spindles (in a direction perpendicular to the plane of FIG. 1) at an upper location of the spinning machine.

In the following, the clearer device 14 and the collecting device 15 will be described in detail.

Figure 2:
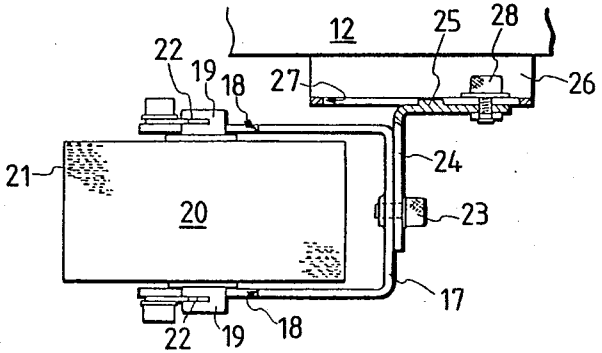

In particular, the clearer device 14 is composed, as shown in a plan view of FIG. 2, of a channel-shaped receiving member 17 secured to a side face of the cradle 12, and a cylindrical roller 20 including a support shaft 19 supported at the opposite ends thereof for rotation in a pair of recesses 18 at the opposite end portions of the receiving member 17, and a belt having a large amount of nap or fluff 21 inclined in one direction is wrapped over an entire outer peripheral face of the roller 20. The roller 20 is provided such that the outer periphery thereof may contact with and roll on both of an outer periphery of the back roller 3 and the apron belt 9. Reference numeral 22 denotes a leaf spring in the form of a hair pin for resiliently pressing the support shaft 19 in the direction indicated by an arrow mark A.

And, the roller 20 is pressed rather strongly against the back roller 3 side by an action of the leaf springs 22 and is thus rotated at the substantially same circumferential speed as the circumferential speed of rotation of the back roller 3 so that the nap 21 thereon may slidably move on a surface of the apron belt 9 relative to the apron belt 9, which is moving at the circulating speed of 5 to 10 times or so of the circumferential speed of the roller 20, in a direction in which the nap 21 is bristled in order to scrape off fiber waste on the surface of the belt 9.

Meanwhile, fixation of the channel-shaped receiving member 17 to the cradle 12 is made for adjustment in position in the following manner, and the distance over which the roller 20 and the back roller 3 are held in rolling contact with each other and the distance over which the roller 20 and the apron belt 9 are held in rolling contact are changed and adjusted such that the roller 20 may be pressed relatively strongly against the back roller 3 so that it may be driven to roll by the back roller 3 while the roller 20 is pressed against the apron belt 9 under a relatively weak pressing force suitable to scrape off fiber waste on the apron belt 9.

In particular, a single projection 25 is formed on a connecting plate 24 of an L-shape in plan which is secured to a rear face of the channel-shaped receiving member 17 by means of a single fastening bolt 23, and the projection 25 is inserted in an elongated hole 27 perforated in a bracket plate 26 secured to the side face of the cradle 12 such that if the fastening bolt 28 is tightened, then the channel-shaped receiving member 17 may be secured to the cradle 12. However, if the fastening bolt 28 is loosened, then the channel-shaped receiving member 17 is allowed to move along the elongated hole 27 so that the position of the roller 20 relative to the drafting device 2 is changed.

Further, if the fastening bolt 23 is loosened, then the channel-shaped receiving member 17 is allowed to pivot around the bolt 23 relative to the connecting plate 24 so that the rolling contacting pressures or the rolling contacting distances of the roller 20 with the back roller 3 and the apron belt 9 may be made equal at left and right portions of the roller 20 (in the direction of the shaft 19 for the roller 20).

Since the clearer device 14 of the present embodiment is composed of the cylindrical roller 20 which is contacted with and rolls on the back roller 3 and the apron belt 9 and is driven to rotate by the back roller 3 as described hereinabove, the roller 20 rotates at a comparatively low circumferential speed equal to the circumferential speed of the back roller 3, and the roller 20 scrapes off fiber waste on the belt 9 due to a difference in speed from the surface of the apron belt 9. However, if the cylinder roller 20 is not driven by rolling contact thereof with the back roller 3 but is driven to rotate by an intermediate transmitting means which has a circumferential speed further reduced by another gear (not shown) or the like which meshes with the back roller 3, then the circumferential speed of the roller 20 will be lower than that of the back roller 3 and a difference in speed will appear between the roller 20 and the back roller 3. Accordingly, also fiber waste on the surface of the back roller 3 can be scraped off by the roller 20.

Further, the clearer device may otherwise be of a type wherein an endless belt (not shown) is employed in place of the cylindrical roller 20.

Subsequently, the collecting device 15 will be described.

Figure 3:
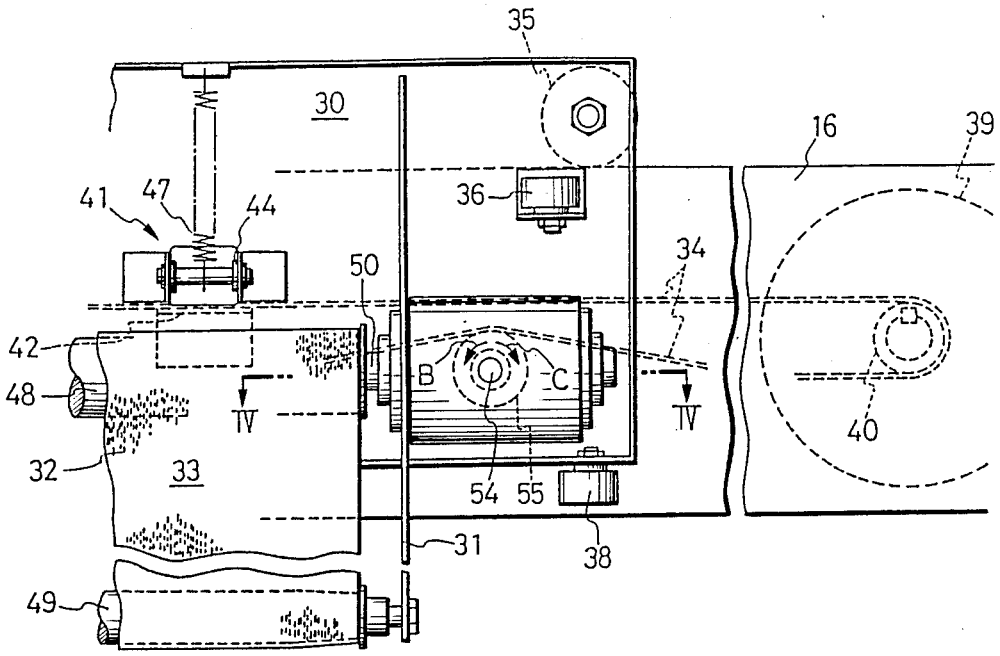

In particular, the collecting device 15 of the present embodiment is composed of a moving frame 30 which can move along the channel member 16, an endless belt 33 having therein inclined nap or fluff 32 of the same material with the surface of the roller 20 and provided for traveling movement on a pair of left and right bearing plate 31 which extend from the moving frame 30 to a position above the drafting device 2, and another endless belt 34 which travels in the channel member 16 as a common driving source for driving of movement of the moving frame 30 on the channel member 16 and for driving of traveling movement of the endless belt 33 (FIGS. 1 and 3). Reference numeral 35 denotes a roller wheel provided at an upper portion of the moving frame 30 for rolling contact with an upper face of the channel member 16, and reference numerals 36, 37 and 38 denote roller wheels provided similarly at upper and lower portions of the moving frame 30 for rolling contact with the side face of the channel member 16, and the moving frame 30 is supported for movement with certainty on the channel member 16 by means of the roller wheels 35, 36, 37 and 38.

The endless belt 34 is stretched between a pulley 40 on an output power shaft of a reversible motor 39 provided on one end side of the channel member 16 (that is, one end side of the spinning machine) and a follower pulley not shown which is provided at the other end side of the channel member 16, and the moving frame 30 is engaged with an upper side horizontally traveling portion of the endless belt 34 by way of an engaging device 41 which will be hereinafter described so that it is moved on the channel member 16 as the endless belt 34 travels.

A pair of limit switches (not shown) which are kicked by the moving frame 30 upon arrival of the moving frame 30 are provided at the opposite ends of the channel member 16, and as one of the limit switches is turned on, the direction of rotation of the reversible motor 39 is reversed so that the direction of traveling movement of the belt 34 is reversed. As a result, the moving frame 30 is automatically moved reciprocally on the channel member 16.

The engaging device 41 is composed of an abutting plate bracket 42 provided projectingly toward the inside of the channel member 16 from the moving frame 30, a lever 44 provided for rocking motion around a horizontal axis relative to the moving frame 30, a pressing member 46 supported for pivotal motion at 45 at an end of the lever 44, and a tension spring 47 anchored at the other end of the lever, and since the endless belt 34 is located between the pressing member 46 and the abutting plate bracket 42 and the lever 44 is normally urged to be pulled by the spring 47, the pressing member 46 and the abutting plate bracket 42 clamp the belt 34 strongly therebetween so that the belt 34 and the moving frame 30 are engaged with each other due to friction therebetween by the clamping force.

Accordingly, in case an unexpected trouble (an operator or the like) which hinders movement of the moving frame 30 during traveling movement of the moving frame 30 on the channel member 16, the moving frame 30 will be stopped promptly at the location while the endless belt 34 continues to travel in vain. Accordingly, such a breakdown as burning of the motor 39 or a break of the belt 34 will not be caused on the driving source (motor 39) side not in a driving transmitting system (belt 34), and besides where the trouble in an operator, a significant impact will not be applied to the operator.

Subsequently, a driving transmitting system between the endless belt 33 and the endless belt 34 will be described.

Figure 4:
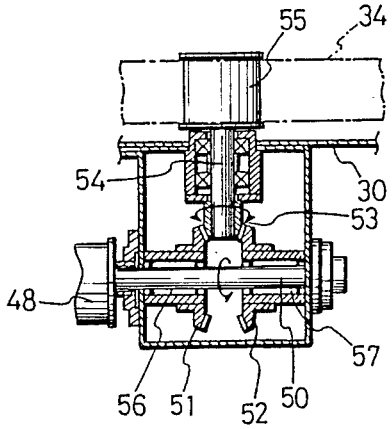

In particular, a transmitting shaft 54 is operatively connected by way of bevel gears 51, 52 and 53 to a shaft 50 for an upper one 48 in FIGS. 1 and 3 of a pair of rolls 48 and 49 between which the endless belt 33 extends. The transmitting shaft 54 extends into the inside of the channel member 16 through a side wall of the moving frame 30. A-pulley 55 is secured to the transmitting shaft 54 and is engaged with a lower side horizontal traveling portion of the endless belt 34 (FIGS. 3 and 4).

And, while the roll 48 is rotated through engagement of the pulley 55 with the traveling endless belt 34 so that the endless belt 33 travels, the bevel gears 51 and 52 are connected to the roll shaft 50 by way of a pair of one-way clutches 58 and 57, respectively, so that even if the traveling direction of the endless belt 34 is reversed as described hereinabove, the endless belt 33 is normally driven to travel in a direction in which the nap 32 on the surface thereof may be bristled upwardly by the surface of the roller 20.

In particular, the one-way clutches 56 and 57 are interposed such that when the transmitting shaft 54 rotates in the direction of an arrow mark B in FIG. 3, the bevel gear 52 may be secured to the roll shaft 50 while the bevel gear 51 is free, but on the contrary when the transmitting shaft 54 rotates in the direction of an arrow mark C in FIG. 3, the bevel gear 51 may be secured to the roll shaft 50 while the bevel gear 52 is free.

Figure 5:
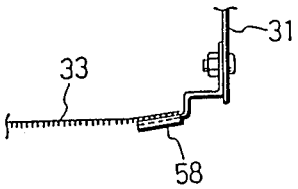

Meanwhile, the opposite ends of the roll 49 on the follower side are formed into a tapered configuration as shown in FIG. 3 while such a pair of guide plates 58 for lifting the opposite ends of the belt 33 a little as shown in FIGS. 1 and 5 are secured intermediately of the bearing plate 31 such that the endless belt 33 may travel in a condition in which the opposite ends thereof are curved upwardly a little above the clearer device 14. Consequently, when the collecting device 15 reciprocally moves along the direction of the row of the spindles of the spinning machine (in the direction perpendicular to the plane of FIG. 1), the belt 33 is not caught by the roller 30.

Since the cleaning device of the present embodiment has such a structure as described so far, as the drafting devices 2 of the spinning machine operate, the roller 20 provided for each of the spindles and having the nap 21 on an outer periphery thereof is automatically rotated so that fiber waste on the surface of the apron belt 9 is scraped off by the nap 21.

And, the fiber waste scraped off from the roller 20 is collected by the collecting device 15 which moves above the drafting devices 2 along the longitudinal direction of the spinning machine.

In particular, since the endless belt 33 contacts lightly with an upper end of the roller 20 (FIG. 1) during traveling movement thereof in the direction of the arrow mark in FIG. 1 as the traveling frame 30 moves, fiber waste on the surface of the roller 20 is scraped off by the nap 32 on the surface of the endless belt 33 and thus sticks to the endless belt 33.

The fiber waste sticking to the endless belt 33 is then scraped off by a scraper 60 provided at a further upper location for reciprocal movement and then collected into a dust box not shown by a sucking nozzle 61. However, even in an arrangement which does not include the scraper 60 nor the sucking nozzle 61, since the endless belt 33 is sufficiently long and travels at a low speed, an operator may collect fiber waste from above the endless belt 33 at intervals of a comparatively long time.

It is to be noted that either a separate small motor may be provided or the roll shaft 50 can be utilized as a driving source of reciprocal motion of the scraper 60.

Figure 8:
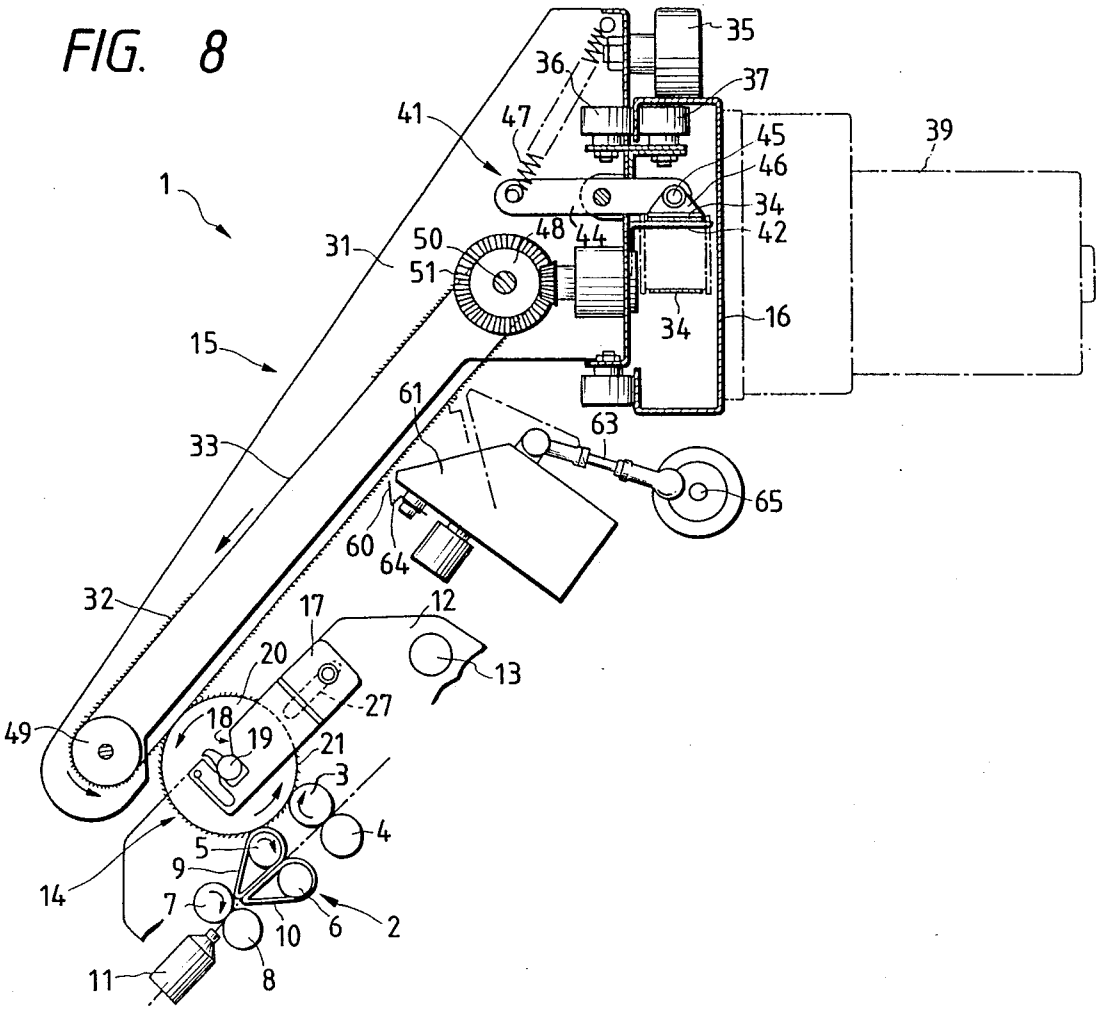
FIG. 8 is a side elevational sectional view of another embodiment of a scraper of the spinning machine as shown in FIG. 1.

The scraper 60 and the sucking nozzle 61 may be so constructed as shown in FIG. 8 wherein the sucking nozzle 61 is formed to be a box-type one being rockable by a piston arm 63 and the scraper 60 is secured to the rocking end of the box-type sucking nozzle 61. In the embodiment shown in FIG. 8, the scraper 60 includes a retaining portion 64 being contiguous to the top end of the sucking nozzle 61 and a scraping portion formed to be bent and extended upward so that fiber wastes scraped by the scraper 60 are contained in the retaining portion 64 and do not fall down therefrom.

The piston arm 63 is reciprocally moved by a rotational driving shaft 65 to which the piston arm 63 is connected. The driving shaft 65 is so mounted to protrude from a driving box which is provided at one side end portion of the spinning machine where the travelling collecting device 15 is returned and the sucking nozzle 61 is located to be adjacent to the driving box.

Figure 6:
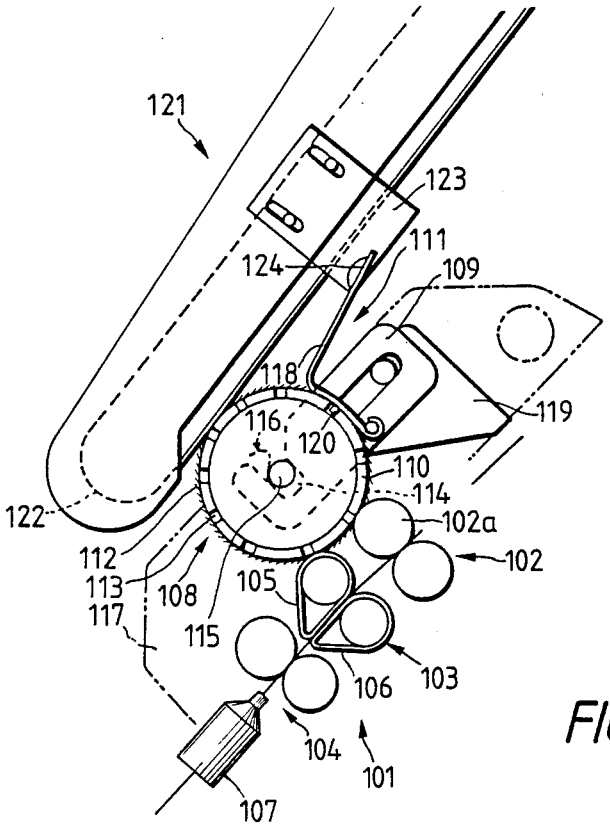
FIGS. 6 and 7 show another embodiment, FIG. 6 being a side elevational view, and FIG. 7 being a perspective view of a cleaner roller.
Figure 7:
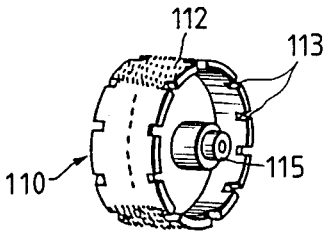

Subsequently, another embodiment wherein the roller 20 is normally held in a stopping condition and is rotated only after the collecting device 15 has arrived the position of the roller 20 of the spindle so that fiber waste thereon may be collected into the collecting device 15 will be described with reference to FIGS. 6 and 7.

A drafting device 101 of a spinning device is composed of a back roller pair 102, a middle roller pair 103 and a front roller pair 104 each including a pair of top side roller and a bottom side roller, and a pair of apron belts 105 and 106 extend around the middle top roller and the middle bottom roller, respectively. An air jetting nozzle 107 is provided for a following step to the drafting device 102, and a winding device not shown is provided for a further next step. A clearer device 108 is provided in the drafting device 101. The clearer device 108 includes a holding plate 109 mounted for sliding movement on a support plate 119 which is secured to a cover member 117 for covering the drafting device 101, a cleaner roller 110 carried for rotation on the holding plate 109, and a rotation stopping mechanism 111 for the freely rotatable cleaner roller 110. The cleaner roller 110 has an exfoliating portion 112 formed thereon by nap in the form of brush provided on an outer peripheral face thereof, and recessed portions 113, 113, . . . recessed in a predetermined spaced relationship are provided on the opposite sides of an outer circumferential wall of the cleaner roller 110. The cleaner roller 110 has a shaft 115 received in a pair of grooves 114 of the holding plate 109 and resiliently pressed by a pair of spring pieces 116 provided in the grooves 114 so that the cleaner roller 110 may be pressed against the drafting device 101. The cleaner roller 110 is thus disposed such that the exfoliating portion 112 thereof may be contacted with both of the back top roller 102*a* and the top side apron belt 105. In this condition, the cleaner roller 110 is rotated by the turning force of the back top roller 102*a* or the top side apron 105. This rotation is stopped by the rotation stopping mechanism 111, and one end of a stop lever 118 bent in an L-shape is secured to the holding plate 109 while the other end of the stop lever 118 is opened, and as the open end 124 is pressed, the stop lever 118 is yieldably turned around the fixed end thereof. The stop lever 118 has a pair of projecting pieces 120 formed thereon, and the projecting pieces 120 can be received in a pair of ones of the recessed portions 113 of the cleaner roller 110 so that rotation of the cleaner roller 110 may be prevented. At a location above the clearer device 108, a fiber waste collecting device 121 is provided which reciprocally travels in parallel to the spindles arranged in a juxtaposed relationship. The fiber waste collecting device 121 is composed of an endless annular belt 122 for contacting with the cleaner roller 110 of the clearer device 108 to remove fiber waste from the roller 110, a driving device not shown similar to that of the preceding embodiment, a traveling device not shown similar to that of the preceding embodiment for causing the belt 122 and the entire driving device for the belt to automatically travel, and a stopping canceling piece 123 for pressing against the open end 124 of the stop lever 118.

Subsequently, an action of the device of the embodiment described above will be described.

In a condition wherein the projected pieces 120 of the stop lever 118 are received in a pair of ones of the recessed portions 113 of the cleaner roller 110, rotation of the cleaner roller 110 is hindered. As the exfoliating portion 112 of the cleaner roller 110 hindered from rotation is held in contact with the rotating back top roller 102*a* and the circulating top side apron belt 105, fiber waste sticking to surfaces of the back top roller 102*a* and the top side apron belt 105 is scraped off and removed by the exfoliating portion 112 of the cleaner roller 110. Fiber waste is thus accumulated gradually only at portions of the exfoliating portion 112 of the cleaner roller 110 which contact with the back top roller 102*a* and the top side apron belt 105. In this condition, if the collecting device 121 which reciprocally travels along the individual spindles provided in a juxtaposed relationship comes to the cleaning device, the stopping canceling piece 123 presses down the open end 124 of the stop lever 118 to resiliently move the stop lever 118 to move the projected pieces 120 away from the recessed portions 113 of the cleaner roller 110. Consequently, the cleaner roller 110 receives and is rotated by the turning force of the back top roller 102*a* or the top side apron 105. The belt 122 of the collecting device 121 is contacted with the exfoliating portion 112 of an outer periphery of the thus rotating cleaner roller 110 so that fiber waste is scraped off from the exfoliating portion 112 to the belt 122. Accordingly, the fiber waste of the exfoliating portion 112 is removed therefrom. After the collecting device 121 passes by the cleaning device, the stop lever 118 is returned so that the projecting pieces 120 are fitted into a pair of ones of the recessed portions 113 of the cleaner roller 110 and consequently rotation of the cleaner roller 110 is stopped. In this condition, fiber waste of the back top roller 102*a* and the top side apron 105 is removed again. It is to be noted that fiber waste is accumulated by a large amount at part of the exfoliating portion 112 of the cleaner roller 110, and in case much time is required until arrival of the collecting device, an operator will push the open end 124 of the stop lever 118 and rotate the cleaner roller 110.

Since the device of the present embodiment is constituted such that rotation of the cleaner roller is stopped by the stopping mechanism and, in this condition, the exfoliating portion of the cleaner roller is contacted with both of the back top roller and the top side apron belt, fiber waste can be removed efficiently from both of the back top roller and the top side apron belt to which fiber waste readily sticks. Consequently, an effect can be exhibited that a yarn of a high quality can be produced.

As described so far, according to a cleaning device of the present invention, since a collecting device is contacted directly with a clearer device to scrape off and sufficiently remove fiber waste from the clearer device, the clearer device can be always held in a condition wherein little fiber waste sticks to the clearer device, and drafting devices of a large number of spindles of the spinning machine can be held in a good operating condition in which little fiber waste sticks to the drafting devices.

What is claimed is:

1. A cleaning device for a drafting device in a spinning machine, comprising:

a clearer device provided at a drafting device of each of a large number of spindles provided in a row in said spinning machine for exfoliating and removing fiber waste sticking to the drafting device, the clearer device having a movable clearing element.

a collecting device for fiber waste which reciprocally moves along said large number of spindles provided in a row above the clearer devices while contacting with said clearer devices and exfoliates and removes fiber waste from said clearer devices for the individual spindles, the collecting device having a movable collecting element, and means for establishing a contact region between the clearing element and the collecting element, including means for moving the clearing element and the collecting element in substantially opposite directions at the contact region between the clearing element and the collecting element.

2. The cleaning device as claimed in claim 1, further comprising a belt, a cradle having a side face and a receiving member which is secured to the side face of the cradle, wherein said clearer device includes a cylindrical roller supported for rotation on the receiving member which is secured to the side face of the cradle supporting upper side draft rollers, said cylindrical roller being wrapped over by the belt having a large amount of nap inclined in one direction and the outer periphery of said cylindrical roller contacting with an outer periphery of the draft rollers.

3. The cleaning device as claimed in claim 2, wherein said cylindrical roller is supported on the receiving member to be adjustable in the supported location thereof, and further comprising pressing means for pressing the outer periphery of the cylindrical roller rather strongly against a back roller of the draft rollers and driving means for driving the cylindrical roller to roll by the back roller while the cylindrical roller is pressed against an apron belt of the draft rollers under a relatively weak pressing force suitable to scrape off fiber waste on the apron belt.

4. A cleaning device for a drafting device in a spinning machine, comprising:

a clearer device provided at a drafting device of each of a large number of spindles provided in a row in said spinning machine for exfoliating and removing fiber waste sticking to the drafting device, and a collecting device for fiber waste which reciprocally moves along said large number of spindles provided in a row above the clearer devices while contacting with said clearer devices and exfoliates and removes fiber waste from said clearer devices for the individual spindles, and further comprising, a belt, a cradle having a side face and a receiving member which is secured to the side face of the cradle, wherein said clearer device includes a cylindrical roller supported for rotation on the receiving member which is secured to the side face of the cradle supporting upper side draft rollers, said cylindrical roller being wrapped over by the belt having a large amount of nap inclined in one direction and the outer periphery of said cylindrical roller contacting with an outer periphery of the draft rollers, wherein said cylindrical roller is supported on the receiving member to be adjustable in the supported location thereof, and further comprising, pressing means for pressing the outer periphery of the cylindrical roller rather strongly against a back roller of the draft rollers and driving means for driving the cylindrical roller to roll by the back roller while the cylindrical roller is pressed against an apron belt of the draft rollers under a relatively weak pressing force suitable to scrape off fiber waste on the apron belt, and wherein said receiving member is a channel-shaped member secured to a side face of the cradle and having a pair of recesses for supporting a shaft of the cylindrical roller, and a projection is formed on a rear face of the receiving member and is inserted in an elongated hole provided to the cradle side and is fixed by a fastening belt to adjust the position and contacting distance of the cylindrical roller with the draft rollers.

5. A cleaning device for a drafting device in a spinning machine, comprising:

a clearer device provided at a drafting device of each of a large number of spindles provided in a row in said spinning machine for exfoliating and removing fiber waste sticking to the drafting device, and a collecting device for fiber waste which reciprocally moves along said large number of spindles provided in a row above the clearer devices while contacting with said clearer devices and exfoliates and removes fiber waste from said clearer devices for the individual spindles, and further comprising, a belt, a cradle having a side face and a receiving member which is secured to the side face of the cradle, wherein said clearer device includes a cylindrical roller supported for rotation on the receiving member which is secured to the side face of the cradle supporting upper side draft rollers, said cylindrical roller being wrapped over by the belt having a large amount of nap inclined in one direction and the outer periphery of said cylindrical roller contacting with an outer periphery of the draft rollers, and wherein said cylindrical roller is driven to rotate by an intermediate transmitting means so that the circumferential speed of the cylindrical roller is lower than that of the back roller and fiber waste on the surface of the back roller is scraped off by the cylindrical roller.

6. A cleaning device for a drafting device in a spinning machine, comprising:

a clearer device provided at a drafting device of each of a large number of spindles provided in a row in said spinning machine for exfoliating and removing fiber waste sticking to the drafting device, and a collecting device for fiber waste which reciprocally moves along said large number of spindles provided in a row above the clearer devices while contacting with said clearer devices and exfoliates and removes fiber waste from said clearer devices for the individual spindles, and wherein said collecting device comprises a moving frame which moves along a channel member extending along the row of spindles, and endless belt having therein inclined nap and provided for travelling movement and supported on the moving frame, and a driving means for the moving frame.

7. The cleaning device as claimed in claim 6, wherein a scraper for scraping off the fiber waste sticking to the endless belt is provided for reciprocal movement against the endless belt and a dust box for sucking the collected fiber waste by the scraper is disposed in the vicinity of the scraper.

8. The cleaning device as claimed in claim 7, wherein said dust box is rockable by a piston arm and the scraper is secured to the rocking end of the dust box.

9. The cleaning device as claimed in claim 8, wherein said scraper is formed to include a retaining portion being contiguous to the top end of the dust box and a scraping portion formed to be bent and extended to the endless belt so that fiber waste scraped by the scraper are contained in the retaining portion.

10. A cleaning device for a drafting device in a spinning machine having top rollers and an apron belt, comprising:

a rotatable cleaner roller having an exfoliating portion formed on an outer peripheral face thereof for contacting with both of one of the top rollers and a top side apron belt of the drafting device to scrape off fiber waste from said top roller and said top side apron belt, collecting means for exfoliating and removing fiber waste from the cleaner roller, means for establishing contact between the cleaner roller and the collecting means, means for rotating the cleaner roller when the cleaner roller and the collecting means are in contact, and a rotation stopping mechanism for preventing rotation of the cleaner roller when the cleaner roller and the collecting means are not in contact.

11. A cleaning device for a drafting device in a spinning machine, comprising:

a cleaner roller provided with a rotation stopping mechanism and having an exfoliating portion formed on an outer peripheral face thereof for contacting with both of one of the top rollers and a top side apron belt of the drafting device to scrape off fiber waste from said top roller and said top side apron belt, wherein said exfoliating portion is a cleaner roller member having a large amount of nap inclined in one direction and recessed portions recessed in spaced relationship and provided on an outer circumferential wall of the cleaner roller member.

12. The cleaning device as claimed in claim 11, wherein said rotation stopping mechanism comprises a stop lever bent in an L-shape and secured to a supporting plate for the cleaner roller at one end thereof while the other end of the stop lever is free, said stop lever having a pair of projecting pieces formed thereon so that the projecting pieces are received in the recessed portions of the cleaner roller member to hinder the rotation of the cleaner roller member.

13. The cleaning device as claimed in claim 12, wherein said cleaning device further includes a collecting device for fiber wastes which reciprocally moves along a large number of spindles provided in a row and contacts with the cleaner roller to remove the fiber wastes therefrom, said collecting device having a stopping canceling piece which presses down the free end of the stop lever to move the projected pieces away from the recessed portions of the cleaner roller member.

14. A device for cleaning a drafting device in a spinning machine, comprising:

clearing means provided at the drafting device for exfoliating and removing fiber waste from the drafting device, the clearing means having a movable clearing element, collecting means for exfoliating and removing fiber waste from the clearing means and for collecting the fiber waste, the collecting means having a movable collecting element, and means for establishing a contact region between the clearing element and the collecting element, including means for moving the clearing element and the collecting element in substantially opposite directions at the contact region between the clearing element and the collecting element.

15. The device as claimed in claim 14, wherein the drafting device includes a draft roller having an outer periphery and wherein the clearing means comprises:

a rotatable cylinder having an outer periphery covered at least in part by substantially uniformly inclined nap, and means for establishing contact between the outer periphery of the cylinder and the outer periphery of the draft roller.

16. The device as claimed in claim 15, wherein the drafting device includes a back roller and an apron belt and further comprising:

means for pressing the outer periphery of the cylinder against the back roller, whereby the cylinder is rotated by the back roller, and means for pressing the outer periphery of the cylinder against the apron belt, whereby fiber waste is scraped from the apron belt.

17. The cleaning device as claimed in claim 15, further comprising:

means for rotating the back roller at a first circumferential speed, intermediate transmitting means for rotating the cylinder at a second circumferential speed, the second circumferential speed being less than the first circumferential speed, whereby fiber waste is scraped from the back roller by the cylinder.

18. The device as claimed in claim 14, wherein the spinning machine includes a row of spindles and wherein the collecting means comprises:

a channel member extending along the row of spindles, a frame, means for moving the frame along the channel member, an endless belt supported on the frame and covered at least in part by substantially uniformly inclined nap, and means for moving the endless belt.

19. The device as claimed in claim 18, further comprising:

a scraper for scraping fiber waste from the endless belt, and a dust box for sucking the collected fiber waste scraped by the scraper.

20. The device as claimed in claim 19, further comprising:

means for rocking at least one end of the dust box, and means for securing the scraper to the rocking end of the dust box.

21. The device as claimed in claim 20, wherein the scraper comprises:

a retaining portion contiguous to the dust box for containing fiber waste scraped by the scraper, and a bent scraping portion extended toward the endless belt.

22. An apparatus for cleaning a drafting device having a draft roller and an apron belt, the apparatus comprising:

a rotatable cleaning roller having an outer peripheral surface, an exfoliating element formed on the outer peripheral surface of the cleaning roller, means for establishing contact between the cleaning roller and the apron belt and between the cleaning roller and the draft roller, collecting means for exfoliating and removing fiber waste from the cleaning roller, means for establishing contact between the cleaning roller and the collecting means, means for rotating the cleaning roller when the cleaning roller and the collecting means are in contact, means for preventing rotation of the cleaning roller when the cleaning roller and the collecting means are not in contact.

23. The apparatus claimed in claim 22, wherein the exfoliating element comprises a substantially uniformly inclined nap and wherein the cleaning roller includes recessed portions provided in spaced relationship on the outer peripheral surface of the cleaner roller.

24. The apparatus claimed in claim 23, wherein the means for preventing rotation of the cleaning roller comprises:

a stop lever, and a projecting piece associated with the stop lever and configured to be received in at least one of the recessed portions of the cleaning roller to thereby prevent rotation of the cleaning roller.

25. The apparatus claimed in claim 24, further comprising:

stop canceling means for moving the projecting piece away from the recessed portions of the cleaning roller to thereby enable rotation of the cleaning roller.

* * * * *